United States Patent [19]

Gawlick et al.

[11] 4,098,169

[45] Jul. 4, 1978

[54] AMMUNITION BELT APPARATUS AND METHOD OF MAKING SAME

[75] Inventors: Heinz Gawlick, Furth; Hans Umbach, Stadeln, both of Fed. Rep. of Germany

[73] Assignee: Dynamit Nobel Aktiengesellschaft, Fed. Rep. of Germany

[21] Appl. No.: 346,893

[22] Filed: Apr. 2, 1973

[30] Foreign Application Priority Data

Apr. 1, 1972 [DE] Fed. Rep. of Germany ..... 2216022
Mar. 2, 1973 [DE] Fed. Rep. of Germany ..... 2310370

[51] Int. Cl.[2] ..... F42B 39/08
[52] U.S. Cl. ..... 89/35 R
[58] Field of Search ..... 24/73 PF, 90 PR; 42/71 R; 85/17, 36; 89/33 MC, 33 BB, 33 BC, 33 L, 33 LA, 35 R; 102/20, 86.5, 43 P

[56] References Cited

U.S. PATENT DOCUMENTS

| | | | |
|---|---|---|---|
| 711,989 | 10/1902 | Marble | 42/71 R |
| 1,429,370 | 9/1922 | Putnam | 89/161 |
| 2,836,215 | 5/1958 | Rapata | 24/73 PF |
| 2,894,426 | 7/1959 | Rapata | 85/36 |
| 3,048,849 | 8/1962 | De Card et al. | 102/43 P |
| 3,328,963 | 7/1967 | Kraus | 89/33 MC |
| 3,611,870 | 10/1971 | Udert et al. | 102/86.5 |
| 3,625,153 | 12/1971 | Gawlick et al. | 102/86.5 |
| 3,673,917 | 7/1972 | Myers | 89/161 |
| 3,739,723 | 6/1973 | Hakala | 102/20 |
| 3,762,328 | 10/1973 | Rocha | 89/35 R |
| 3,796,124 | 3/1974 | Crosa | 85/36 |
| 3,798,819 | 3/1974 | Hillberg | 42/71 R |

FOREIGN PATENT DOCUMENTS

| | | | |
|---|---|---|---|
| 641,617 | 11/1930 | Fed. Rep. of Germany | 89/35 R |

*Primary Examiner*—Stephen C. Bentley
*Attorney, Agent, or Firm*—Craig & Antonelli

[57] ABSTRACT

Ammunition belt apparatus for accommodating propellant cartridges including a flexible, coilable belt strip, a plurality of holes extending transversely through the strip and spaced from one another in the longitudinal direction of the strip, and clamping means associated with each of the holes for clamping a cartridge to the strip with portions of the cartridge extending through one of the holes, and with parts of said clamping means being formed separately from the strip and the cartridge. In preferred embodiments, the clamping means includes a tubular casing formed separately from the strip for each of the holes, which tubular casing press-fittingly engages a respective cartridge for holding the cartridge in position on the strip with the casing and a cartridge rim clamping the strip therebetween. Various preferred embodiments include various types of connections for the casings at the strip as well as various materials for the construction of the strip and the casings.

36 Claims, 11 Drawing Figures

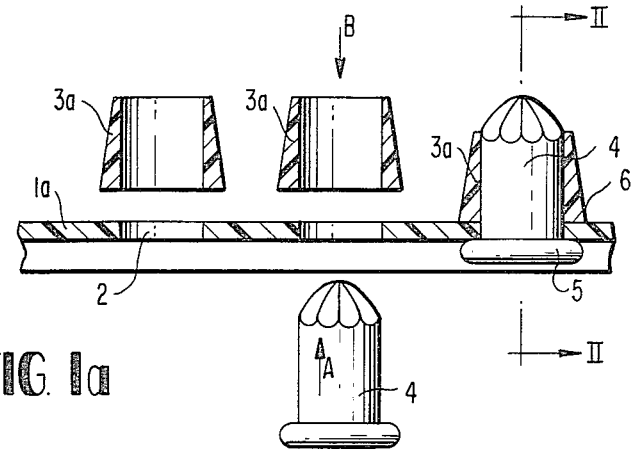
FIG. 1a
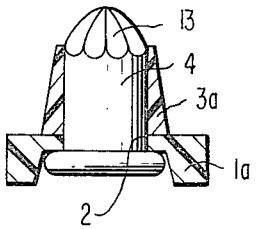
FIG. 2
FIG. 1b
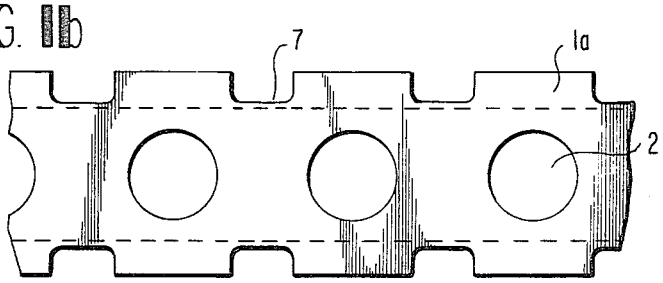
FIG. 3a
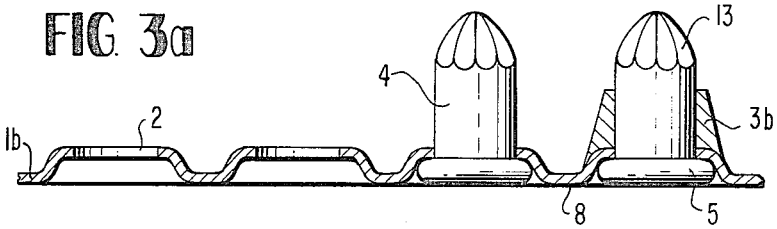
FIG. 3b
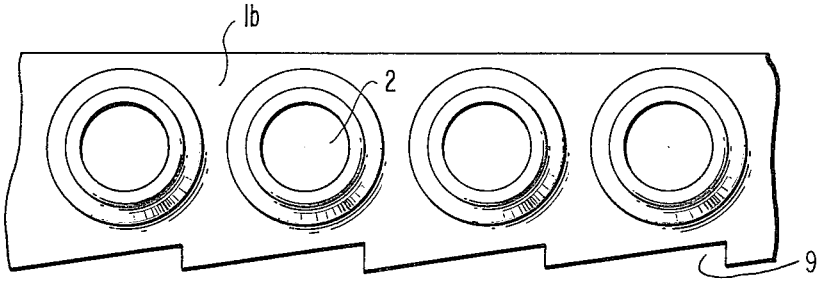

AMMUNITION BELT APPARATUS AND METHOD OF MAKING SAME

BACKGROUND AND SUMMARY OF THE INVENTION

This invention relates to an ammunition belt apparatus for propellant cartridges, rimfire cartridges, or the like, with a flexible coilable strip of a metal, a synthetic resin, or the like having spaceapart apertures and associated tubular casings into which the propellant cartridges, rimfire cartridges, or the like can be placed from the side of the belt facing away from the casings, in the manner of a press fit, until abutment is obtained with the rim of the cartridge laterally projecting in the zone of its base. This invention also relates to the method of making the above-mentioned apparatus.

An ammunition belt — also called cartridge magazine — is known from DOA (German Unexamined Published Application) No. 1,678,396 for stud drivers driven by powder force. This ammunition belt with recesses and associated tubular casings is manufactured in one piece from a synthetic resin by the injection molding method. The propellant cartridges are pushed into the recesses and the adjoining casings and held therein by a press fit. For firing purposes, the cartridges are not removed from the ammunition belt but rather are introduced together with the casing into the cartridge chamber of the stud driver and, after firing, again removed from the chamber together with the casing and/or the ammunition belt. Thus, the cartridges remain in the cartridge belt during feeding to the firing tool, during firing, and during removal from the firing tool. This makes it possible to construct the firing tool in a relatively simple manner.

However, the conventional cartridge belts depicted in the DOA No. 1,678,396 are not entirely satisfactory in practice because they have only a limited length, due to the manufacture by the injection molding process, and because they are too expensive in their manufacture, since they can be used only once.

The present invention is based, at least in part, on the problem of avoiding the above-mentioned disadvantages, i.e. constructing an ammunition belt for propellant cartridges, rimfire cartridges, or the like so that it can be produced with practically any desired length with a minimum of expense, in order to still further simplify the work with firing tools especially for commercial usage, for example stud drivers, cattle stunning devices, or appliances for the deformation of materials.

According to the present invention, the above-mentioned problems are solved, for a cartridge belt of the type mentioned in the foregoing, by providing that the belt or strip part of the belt and the casings are produced separately from each other and are joined by means of the inserted propellant cartridges, rimfire cartridges, or the like, by enclosing the strip between the rims of the cartridges and the casings. This arrangement makes it possible advantageously to produce the belt, for example of a synthetic resin, by means of extrusion in any desired length — so to speak in an endless form — and then to perforate the belt continuously to produce holes distributed at uniform spaces along its length. The casings manufactured separately therefrom, for example, by the injection molding method, are simply placed on the propellant cartridges, rimfire cartridges, or the like which have been pushed through the perforations. In this connection, the radial play between the shell or cartridge case and the casing is dimensioned so that both are securely joined by a frictional connection in the manner of a press fit, and thus are also simultaneously connected with the belt.

In another preferred embodiment of the present invention, the strip for the ammunition belt is maufactured of metal rather than a synthetic resin, the production of the perforations being likewise effected by continuous punching as described above for the extruded synthetic resinous strip. The cartridge shell or cartridge case is connected with the separately manufactured casings in the same manner as in the plastic (synthetic resinous material) strip.

In another advantageous preferred embodiment of the invention, the casings are additionally provided with an external annular groove in the zone of their ends on the side of the strip so that they can be inserted in the perforations of the strip by a snap connection with corresponding annular tongues provided at the perforations of the strip. Since the inserted propellant cartridges, shells, or the like effect an additional radial contact pressure between groove and tongue, it is possible in this embodiment to increase the strength of the connection between the strip and the casings considerably, if this should prove appropriate or advantageous in individual cases. According to another suggestion of this invention, the provision can furthermore be made to equip the casings, in the zone of their ends on the strip side, with at least respectively one slot extending in the longitudinal direction of the casings, in order to enhance the elastic deformation of the end of the casings occurring when the casings are pressed into engagement with the annular tongues at the perforations.

The feature of this invention of manufacturing the belt strip and the casings separately and then joining them subsequently in a simple manner offers, however, still another considerable advantage. The cartridge belt strip, manufactured with a relatively great length, must be coilable, on the one hand, for reasons of compactness, so that the belt strip must be correspondingly elastic and/or flexible in order to be easily wound and unwound. On the other hand, the casings which are introduced together with the shells, cartridges, or the like into the chamber of the respective firing device form part of this chamber and also take over a part of its function. In order to ensure the flawless firing and also the ejection of the shells, cartridges, or the like, the casings must safely withstand the thermal and mechanical stresses in the chamber of the firing device. The requirements to be met by the properties of the material of the belt and the casings are accordingly different.

These differing requirements can be satisfied in an extremely simple and advantageous manner, according to another suggestion of this invention, by manufacturing the belt from a readily flexible material, whereas the casings are produced from a material having a higher strength, a higher thermal stability, and a lower fluidity or flow property. It is advantageous, in this connection, to make the belt from polyethylene or polypropylene, whereas the casings are preferably produced from polyamide, polycarbonate, or cellulose acetate. However, it is, of course, also possible according to the present invention to utilize combinations different therefrom, i.e., for example to manufacture the strip from polyamide and the casings from polypropylene, if this should prove advantageous in a certain case. The geometric shape of the casings is determined, by the way, in accordance with the configuration and the dimensions of the cartridge, shell, or the like, the chamber of the firing device, etc. so as to accommodate press-fitting of the casings over the cartridges and so as to fit the firing device chamber.

According to further embodiments of this invention, the cartridge belt is constructed for use with caseless propellant charges. These caseless propellant charges can be formed, for this purpose, for example with a laterally projecting rim integrally formed at the rear end, so that the strip is held between this rim and the casings pushed with frictional connection onto the propellant charges. With this arrangement, unless the casings are joined to the strip of the belt in some other, additional manner, they are detached therefrom after the reaction of the propellant charges and are then ejected toward the rear by the residual pressure of the powder gases still present in the chamber of the firing device, before the subsequent propellant charge is fed into the chamber, so that the next propellant charge with its casing can then be introduced into the chamber.

Instead of producing the caseless propellant charges with a projecting, integrally formed rim, it is also contemplated, according to another embodiment of this invention, to provide the rim of the propellant charges necessary for the connection with the strip by an annular mounting element pushed onto the charges. This mounting element can be joined with the propellant charge, for example, by gluing or also merely by a press fit. In view of a maximally simple and rapid, but yet reliable realization of this connection, a further suggestion of this invention provides to manufacture the mounting element of an elastically deformable material and to hold the element at the propellant charges by a frictional connection. For this purpose, the mounting element can be manufactured, for example, from an elastic rubber or also from thermoplastic synthetic resins, such as, for example, polyethylene or polypropylene. This construction offers the additional advantage, moreover, that the mounting element is simultaneously effective as a rearward seal for the chamber of the firing device, so that the powder gases cannot escape unduly toward the rear and perhaps ignite the propellant charges still outside of the firing device. In order to effect a maximally safe frictional mounting of the caseless propellant charges, the casings are preferably also manufactured from an elastically expandable material.

BRIEF DESCRIPTION OF THE DRAWINGS

FIG. 1*a* is a longitudinal partial sectional view schematically illustrating an ammunition belt apparatus constructed in accordance with the present invention in various stages of attachment of a propellant cartridge to the belt strip;

FIG. 1*b* is a plan view of a portion of the belt strip of FIG. 1*a;*

FIG. 2 is a partial cross-sectional view taken along line II—II of FIG. 1*a;*

FIG. 3*a* is a longitudinal partial sectional view schematically illustrating a further embodiment of an ammunition belt apparatus constructed in accordance with the present invention with propellant cartridges in various stages of attachment to the belt strip;

FIG. 3*b* is a plan view of a portion of the belt strip of FIG. 3*a;*

DETAILED DESCRIPTION OF THE DRAWINGS

Figure 4:
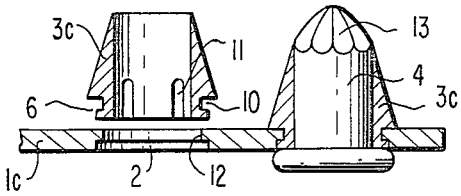
FIG. 4 is a longitudinal partial sectional view schematically illustrating another embodiment of an ammunition belt apparatus constructed in accordance with the present invention with a casing in various stages of attachment to a cartridge and belt strip.

In the following detailed description and in the drawings similar reference numerals are included to indicate similar features illustrated in the various Figures.

According to FIG. 1*a,* the strip 1*a* of a synthetic material, produced in any desired length by extrusion, is provided at equal spacings with perforations or holes 2, each of which is associated with one of the heat- and pressure-resistant tubular casings 3*a* which are likewise produced from a synthetic resin, for example in an injection molding or pressure molding process. According to arrow A, the propellant cartridge 4 is introduced from the underside and the casing 3*a,* according to arrow B, is introduced from the topside of the strip 1*a.* In the final assembled position, shown at the righthand side of FIG. 1*a,* the cartridge 4 firmly contacts the strip 1*a* with its rim 5, and the casing 3*a* is in firm contact with the strip by means of its end 6 on the belt side. The cartridge 4 is securely held in the casing 3*a* by means of a press fit, so that it cannot fall out of the ammunition belts either during transport or when the belt is fed into and/or removed from the firing device.

FIG. 1*b* shows a section of the strip 1*a* of the ammunition belt in a plan view without cartridges and casings. The lateral recesses 7 formed at regular intervals serve for accommodating the advance of the cartridge belt in the firing device by interengagement with advancing means (not shown) of the firing device.

FIG. 2 illustrates the strip 1*a* of the ammunition belt in a cross-sectional view along the section line II—II in FIG. 1*a* with a cartridge 4 inserted in the perforation 2 and with a casing 3*a* pushed thereover. In this view, the U-shaped configuraton of the strip with the legs of the U extending beyond the rim of the cartridge is shown.

In accordance with FIGS. 3*a* and 3*b,* the strip 1*b,* manufactured of a metallic band, is dished by deep-drawing toward the topside in the zone of the perforations 2, so that the cartridges 4 pushed into the holes 2 are more or less flush with the underside 8 of the strip 1*b,* with the underside of their rims 5. The cartridges 4 here again are held in the perforations 2 by means of casings 3*b* in the same manner as described above for the casings 3*a* of the embodiment of FIG. 1*a.*

FIG. 3*b* shows the metallic strip 1*b* of FIG. 3*a* in a fragmentary top view without cartridges and casings, in a top view. The advancing cams 9 serving in a manner similar to recesses 7 in strip 1*a* for the feeding of the strip 1b are formed as serrations along one side of the strip 1b.

FIG. 4 illustrates another preferred embodiment and shows, in the lefthand portion, the casing 3c with a groove 10 formed at the end 6 on the strip side, and with slots 11 extending in the longitudinal direction. The strip 1c is provided with an annular tongue 12 in the zone of the hole 2. In the righthand portion of this Figure, the casing 3c is shown after insertion in the perforation 2, wherein the groove 10 and the tongue 12 interlock. This shape-mating connection further supports the frictional coupling by the cartridge 4 inserted in the perforation 2 and the casing 3c.

The propellant cartridge 4 is shown in a plan view in the Figures. The cartridge has a cartridge case of metal closed at the front end by means of the crimp 13. It is, of course, also contemplated according to other preferred embodiments of the present invention to employ a cartridge case made of a synthetic resin, cardboard, or the like instead of the metallic case. Also, in place of the propellant cartridge shown herein, it is also contemplated by the present invention to employ a shell — e.g. a rimfire cartridge. The shell or cartridge for commercial and/or military purposes should preferably have a laterally projecting rim, cam, or the like in the zone of the base thereof corresponding to rim 5 illustrated in the drawings for ensuring the secure mounting in the casing and thus in the ammunition belt strip.

Figure 5A:
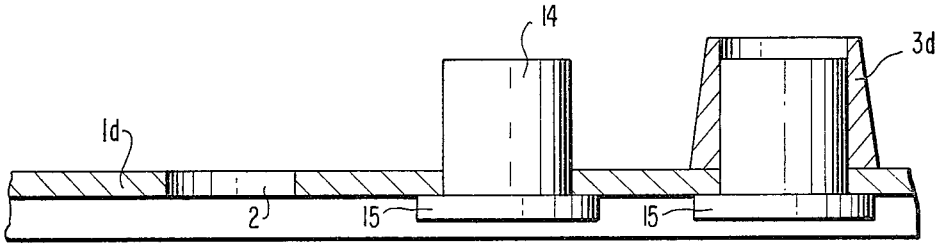
FIG. 5*a* is a longitudinal partial sectional view schematically illustrating a further embodiment of an ammunition belt apparatus constructed in accordance with the present invention with propellant cartridges in various stages of attachment to the belt strip.
Figure 5B:
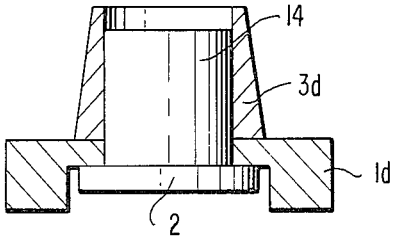
FIG. 5*b* is a partial cross-sectional view taken in a direction transverse to the FIG. 5*a* view.

According to a further preferred embodiment illustrated in FIGS. 5a and 5b, caseless propellant charges 14 are inserted in the perforations 2 of the strip 1d. These charges 14 contact the strip 1d with their rims 15 and are held in this position by means of the casings 3d in a manner similar to that described above in connection with FIG. 1a and casing 3a. Since the casings 3c also function as cases for the caseless charges 14, these casings 3d should be selected and dimensioned for carrying out this purpose. Although illustrated casings 3d in FIGS. 5a and 5b completely surround and project above the cartridges 14, other arrangements of the casings 3d which accommodate both attaching the cartridges and assisting in containing the explosive charge are also contemplated.

Figure 6A:
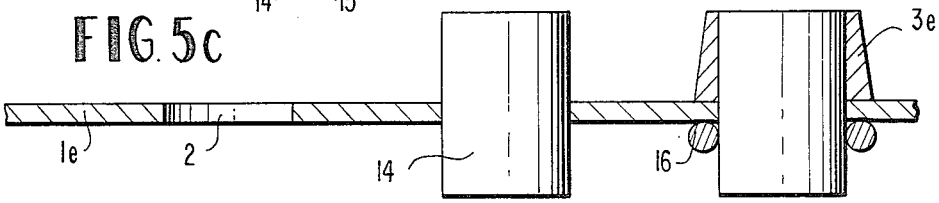
FIG. 6*a* is a longitudinal partial sectional view schematically illustrating a further embodiment of an ammunition belt apparatus construction in accordance with the present invention with propellant cartridges in various stages of attachment to the belt strip.
Figure 6B:
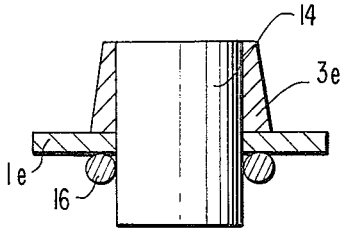
FIG. 6*b* is a partial cross-sectional view taken in a direction transverse to the FIG. 6*a* view.

The caseless propellant charge 14 shown in the preferred embodiment of FIGS. 6a and 6b is provided with an annular mounting element 16 instead of with an integrally formed rim as in the FIG. 5a embodiment. In order to attain a defined position of the propellant charge 14 in the strip 1e, the charges can be disposed, with their front end face, flush with the front end of the casings 3e as illustrated in FIGS. 6a and 6b. The propellant charges 14, shown as projecting toward the rear beyond the mounting element 16 in order to provide a maximally secure mounting in FIGS. 6a and 6b, can optionally be pushed toward the front into the chamber by the breechblock of the firing device until they are flush with the mounting element 16.

Although the drawings illustrate preferred embodiments for accommodating the propellant charges 14 and 4 of circular cross-section, the present invention also contemplates preferred embodiments utilizing square, hexagonal, or other cross-sectional configurations of the charges. The circular construction exhibits advantages in simplicity of construction of the various components of the belt apparatus.

Figure 5C:
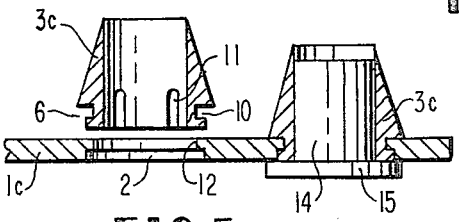
FIG. 5*c* is a longitudinal partial sectional view similar to FIG. 4, depicting another embodiment for holding caseless cartridges.

It is further noted that the features illustrated in one embodiment may be advantageously substituted for corresponding modified features of another embodiment within the purview of the present invention. For example, the FIG. 4 groove and tongue connected casing 3c could also be utilized in place of casing 3d in the FIG. 5a embodiment. FIG. 5c illustrates this last-mentioned arrangement, with the only difference between FIG. 5c and the FIG. 4 arrangement described above being the substitution of the caseless propellant cartridge 14 for the cased cartridge 4.

While we have shown and described only several embodiments in accordance with the present invention, it is understood that the same is not limited thereto but also contemplates numerous changes and modifications as would be known to those skilled in the art given the present disclosure of the invention, and we therefore do not wish to be limited to the details shown and described herein only schematically but intend to cover all such changes and modifications.

We claim:

1. Ammunition belt apparatus comprising:

a flexible coilable strip, at least one hole extending transversely through said strip, a cartridge associated with each of said at least one holes, and clamping means associated with each of said at least one holes for clamping respective ones of said cartridges to said strip with portions of respective ones of said cartridges extending through respective holes, wherein each of said clamping means includes a tubular casing and a rim means, said tubular casing being formed separately from said strip and having an internal wall surface configuration dimensioned to form a press fit with outer wall surfaces of said cartridge, said tubular casing having at least one lateral part with lateral outer dimensions greater than the dimensions of said hole for preventing movement of said tubular casing through said hole, said rim means being engaged with a first side of said strip and said at least one lateral part of said tubular casing being engaged with a second side of said strip directly opposite said first side such that said strip is clamped between said rim means and said lateral part of said tubular casing when said cartridge is clamped in position on said strip, all portions of said cartridge which are located on said first side of said strip having a cross-sectional size at least as small as the cross-sectional size of the hole, said rim means being formed separately of said cartridge and being clampingly engaged with outer wall surface portions of said cartridge at a predetermined position along the length of said cartridge for preventing movement of said cartridge through said hole, wherein said at least one hole includes a plurality of holes spaced from one another along the length of the strip, wherein said tubular casings are open at opposite ends thereof, and wherein said cartridges are caseless propellant cartridges having a predetermined length at said second side which is no greater than the length at said second side of respective ones of said tubular casings press fitted to the respective cartridges.

2. Apparatus according to claim 1, wherein said tubular casings have a length at said second side which is greater than the length of said propellant cartridges at said second side.

3. Apparatus according to claim 1, wherein said tubular casings have a predetermined geometric configuration corresponding to the geometric configuration of a firing device chamber to accommodate retention of said tubular casing in clamping engagement with a cartridge during firing thereof.

4. Ammunition belt apparatus comprising:

a flexible coilable strip, at least one hole extending transversely through said strip, a cartridge associated with each of said at least one holes, and clamping means associated with each of said at least one holes for clamping respective ones of said cartridges to said strip with portions of respective ones of said cartridges extending through respective holes, wherein each of said clamping means includes a tubular casing and a rim means, said tubular casing being formed separately from said strip and having an internal wall surface configuration dimensioned to form a press fit with outer wall surfaces of said cartridge, said tubular casing having at least one lateral part with lateral outer dimensions greater than the dimensions of said hole for preventing movement of said tubular casing through said hole, said rim means being engaged with a first side of said strip and said at least one lateral part of said tubular casing being engaged with a second side of said strip directly opposite said first side such that said strip is clamped between said rim means and said lateral part of said tubular casing when said cartridge is clamped in position on said strip, each of said tubular casings being open at respective opposite ends thereof, each of said cartridges being a caseless propellant cartridge having a predetermined length at said second side which is no greater than the length at said second side of a respective one of said tubular casings press fitted thereto when said cartridges are clamped in position on said strip.

5. Apparatus according to claim 4, wherein said at least one hole includes a plurality of holes spaced from one another along the length of the strip.

6. Apparatus according to claim 5, wherein said tubular casings have a predetermined geometric configuration corresponding to the geometric configuration of a firing device chamber to accommodate retention of said tubular casing in clamping engagement with a cartridge during firing thereof.

7. Apparatus according to claim 4, wherein said tubular casing is a one-piece casing which is the only part of said clamping means disposed at the second side of said strip when said cartridge is clamped in position on said strip.

8. Apparatus according to claim 7, wherein the internal wall surface configuration of said tubular casing which is dimensioned to form a press fit with outer wall surfaces of said cartridge is disposed entirely at said second side of the strip.

9. Apparatus according to claim 8, wherein said rim means is axially fixed along the length of said cartridge when said cartridge is clamped in position on said strip, and wherein said rim means has lateral dimensions larger than said hole to prevent movement of said rim means through said hole.

10. Apparatus according to claim 9, wherein said rim means is integrally formed with said cartridge as an annular rim projecting laterally from the outer wall surfaces of said cartridge.

11. Apparatus according to claim 9, wherein said rim means is formed separately of said cartridge and clampingly engages said cartridge at a predetermined position along the length of said cartridge when said cartridge is clamped in position on said strip.

12. Apparatus according to claim 11, wherein said rim means is constructed of an elastically deformable material which is clampingly engaged with outer wall surface portions of said cartridge by frictional connection therewith.

13. Apparatus according to claim 7, wherein one of said tubular casing and said hole is provided with an annular groove, and wherein the other of said tubular casing and said hole is provided with an annular tongue which is engageable with said annular groove to snap fittingly connect said tubular casing and said strip to one another.

14. Apparatus according to claim 13, wherein said tubular casing is provided with said annular groove as an external annular groove adjacent one end thereof, and wherein said hole is provided with said annular tongue as an inwardly projecting annular tongue.

15. Apparatus according to claim 14, wherein said tubular casing has at least one slot extending perpendicular to and adjacent said annular groove to facilitate bending of said tubular casing to fit onto said annular tongue.

16. Apparatus according to claim 8, wherein one of said tubular casing and said hole is provided with an annular groove, and wherein the other of said tubular casing and said hole is provided with an annular tongue which is engageable with said annular groove to snap fittingly connect said tubular casing and said strip to one another.

17. Apparatus according to claim 16, wherein said tubular casing is provided with said annular groove as an external annular groove adjacent one end thereof, and wherein said hole is provided with said annular tongue as an inwardly projecting annular tongue.

18. Apparatus according to claim 7, wherein said tubular casing is constructed of a material having a greater strength, a higher thermal stability and less resiliency than the material of the strip.

19. Apparatus according to claim 8, wherein said tubular casing is constructed of a material having a greater strength, a higher thermal stability and less resiliency than the material of the strip.

20. Apparatus according to claim 18, wherein said strip is constructed of one of polyethylene and polypropylene.

21. Apparatus according to claim 18, wherein said tubular casing is constructed of one of polyamide, polycarbonate, and cellulose acetate.

22. Apparatus according to claim 20, wherein said tubular casing is constructed of one of polyamide, polycarbonate, and cellulose acetate.

23. Apparatus according to claim 10, wherein said rim means is a laterally protruding integral end portion of said cartridge case.

24. Apparatus according to claim 7, wherein said at least one hole includes a plurality of holes spaced from one another along the length of the strip.

25. Apparatus according to claim 8, wherein said at least one hole includes a plurality of holes spaced from one another along the length of the strip.

26. Apparatus according to claim 13, wherein said at least one hole includes a plurality of holes spaced from one another along the length of the strip.

27. Apparatus according to claim 24, wherein said strip includes detent means for facilitating advancement of said strip thru a machine where the cartridges are to be discharged.

28. Apparatus according to claim 18, wherein said at least one hole includes a plurality of holes spaced from one another along the length of the strip.

29. Apparatus according to claim 25, wherein said strip exhibits a transverse U-shaped cross-section, and wherein said first side is disposed between the legs of the U.

30. Apparatus according to claim 29, wherein the legs of the U are of sufficient length to protrude beyond the rim means in a direction facing outwardly from said first side away from said second side.

31. Apparatus according to claim 25, wherein said strip is an extruded strip of relatively resilient material and wherein said tubular casings are molded casings of relatively more rigid material than said strip.

32. Apparatus according to claim 25, wherein said strip is a flat strip.

33. Apparatus according to claim 25, wherein said strip is a metal strip.

34. Apparatus according to claim 4, wherein said strip includes detent means for facilitating advancement of said strip thru a machine where the cartridges are to be discharged.

35. Apparatus according to claim 4, wherein said rim means is axially fixed along the length of said cartridge when said cartridge is clamped in position on said strip, wherein said rim means has lateral dimensions larger than said hole to prevent movement of said rim means through said hole, wherein said rim means is formed separately of said cartridge and clampingly engages said cartridge at a predetermined position along the length of said cartridge when said cartridge is clamped in position on said strip, and wherein said rim means is constructed of an elastically deformable material which is clampingly engaged with outer wall surface portions of said cartridge by frictional connection therewith.

36. Apparatus according to claim 4, wherein one of said tubular casing and said hole is provided with an annular groove, and wherein the other of said tubular casing and said hole is provided with an annular tongue which is engageable with said annular groove to snap fittingly connect said tubular casing and said strip to one another.

* * * * *